US007690239B2

(12) United States Patent
Griffis

(10) Patent No.: US 7,690,239 B2
(45) Date of Patent: Apr. 6, 2010

(54) SHEET METAL PRY HOOKS

(76) Inventor: Robert J. Griffis, 2421 Shawn Dr., San Pablo, CA (US) 94806

( * ) Notice: Subject to any disclaimer, the term of this patent is extended or adjusted under 35 U.S.C. 154(b) by 141 days.

(21) Appl. No.: 12/003,920

(22) Filed: Jan. 3, 2008

(65) Prior Publication Data

US 2009/0173651 A1 Jul. 9, 2009

(51) Int. Cl.
*B21D 3/10* (2006.01)
*B25B 27/00* (2006.01)

(52) U.S. Cl. ..... 72/458; 72/479; 72/705; 81/3.55; 81/427.5; 29/283.5; 29/243.5

(58) Field of Classification Search ..... 72/457, 72/458, 459, 477, 479, 705; 81/3.55, 427.5; 29/283.5, 243.5
See application file for complete search history.

(56) References Cited

U.S. PATENT DOCUMENTS 1,286,488 A * 12/1918 Amberg ..... 72/458
1,326,907 A * 1/1920 Bond ..... 72/458
1,344,533 A * 6/1920 Cole ..... 72/458
1,616,653 A * 2/1927 Lee et al. ..... 72/458
1,879,583 A * 9/1932 Stowell ..... 72/458
3,706,154 A * 12/1972 Luebbers et al. ..... 81/177.6
4,236,427 A * 12/1980 Becnel ..... 81/15.9
4,841,821 A * 6/1989 Cooper ..... 81/426
4,934,174 A 6/1990 Groalund
5,394,729 A * 3/1995 Eisenhower, Jr. ..... 72/450
5,575,052 A * 11/1996 Thoresen ..... 81/486
5,937,695 A * 8/1999 Patterson ..... 72/458

* cited by examiner

*Primary Examiner*—David B Jones
(74) *Attorney, Agent, or Firm*—Richard C. Litman

(57) ABSTRACT

The sheet metal pry hooks are pry hooks having a hook end oriented in a manner to allow gripping and bending of an automotive sheet metal panel(s) in almost any situation encountered in the repair of such panel(s). As presently contemplated, the pry hooks will be made available either individually or as a kit of three pry hooks having different configurations of the hook, including at least one hook having the hook member offset from the longitudinal axis of the shank of the tool. The kit allows a user to have at hand a complete array of hooks needed for bending and orienting sheet metal panels in almost any repair situation.

2 Claims, 4 Drawing Sheets

SHEET METAL PRY HOOKS

BACKGROUND OF THE INVENTION

1. Field of the Invention

The present invention generally relates to hand tools. More specifically, the present invention is drawn to sheet metal pry hooks used to align and orient automobile sheet metal panels.

2. Description of the Related Art

In the automotive body repair art, overbending and distorting the relatively thin, sheet metal body parts often necessitates the use of plastic fillers and the like to repair the damaged sheet metal. The use of such fillers often lessens the value of the automobile. The art would certainly welcome a set of tools that could efficiently bend and align the edges of relatively thin panels of sheet metal to prevent over-bending and distortion and eliminate the use of plastic fillers and the like. Thus, a kit of sheet metal pry hook tools solving the aforementioned problems is desired.

SUMMARY OF THE INVENTION

The sheet metal pry hooks comprise a kit of sheet metal pry hook tools wherein each tool in the kit has a hook end oriented in a manner to allow gripping and bending of an automotive sheet metal panel in almost any situation encountered in the repair of such panels. As presently contemplated, the tools will be made available as a kit. This arrangement allows a user to have at hand a complete array of hooks needed for bending and orienting sheet metal panels in almost any repair situation.

Accordingly, the invention presents a kit of tools that are effective in facilitating bending, aligning and orienting sheet metal panels in a variety of applications. Each tool of the set incorporates a hook end of a configuration especially adapted to a specific bending, aligning or orienting task. The invention provides for an arrangement of improved elements for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
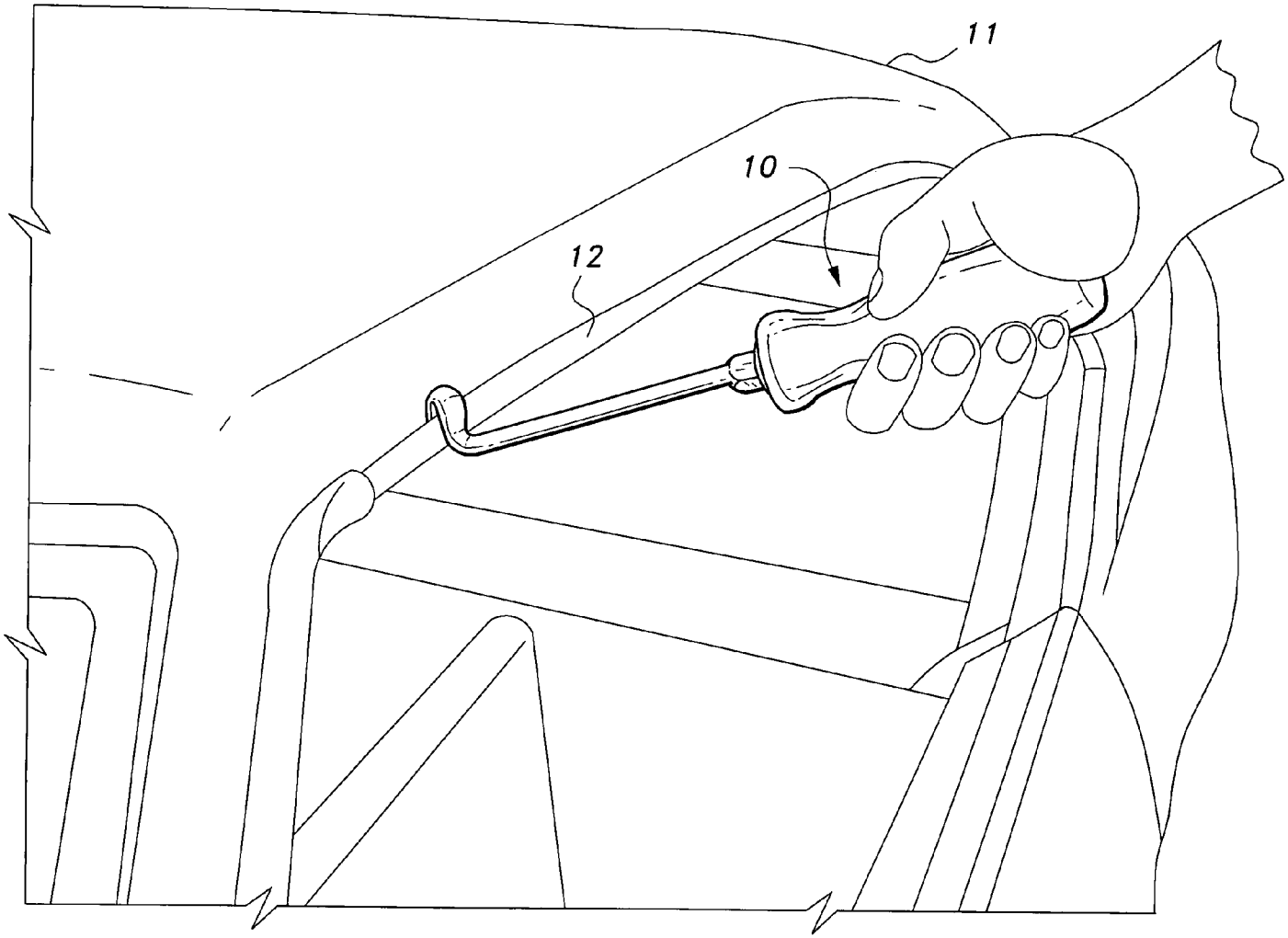
FIG. 1 is an environmental, perspective view of a first sheet metal pry hook included in a kit of sheet metal pry hooks according to the present invention.
Figure 2:
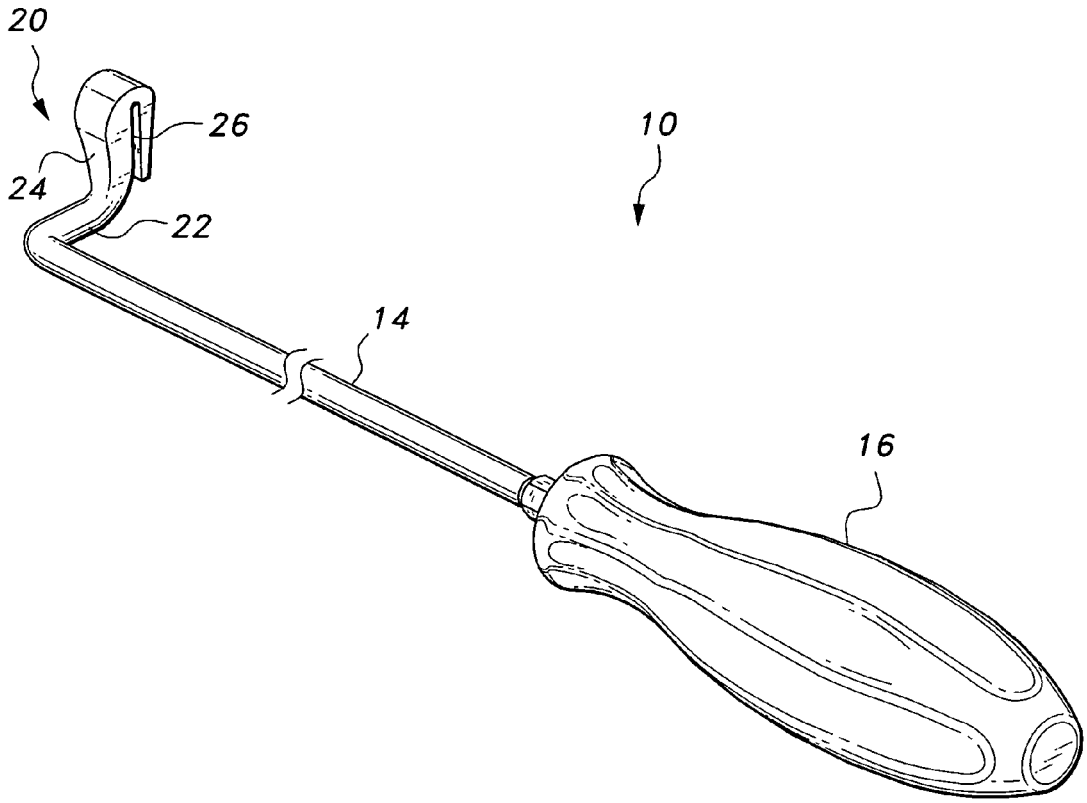
FIG. 2 is a perspective view of the sheet metal pry hook of FIG. 1.
Figure 3:
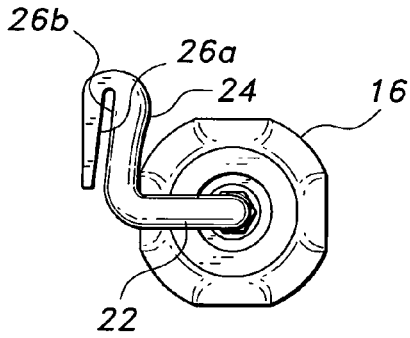
FIG. 3 is an end view of the sheet metal pry hook of FIG. 1.

Attention is first directed to FIGS. 1-3 wherein a first sheet metal pry hook is generally indicated at 10. Sheet metal pry hook 10 is utilized to grasp, bend and align the edges 12 of a sheet metal panel on an automobile 11. As indicated above, tool 10 is effective in facilitating bending, aligning and orienting sheet metal panels in a variety of applications.

The pry hook 10 comprises a shank portion 14 having one end terminating in a handle 16. The other end of shank 14 is defined as a hook member 20. Hook member 20 includes a first bend portion 22 that is perpendicular to the longitudinal axis of shank 14. A second bend portion 24 extends perpendicular to a plane containing both the shank 14 and the first bend portion 22. The second bend portion 24 terminates in a U-shaped, open-ended slot 26. The slot 26 is formed with spaced, parallel, planar faces 26*a*, 26*b*. The planar face configuration permits grasping of a sheet metal edge without unduly marring the edge. Hook 20 is laterally offset from the longitudinal axis of shank 14. The pry hook 10 allows a user to grasp, bend, and orient sheet metal edges that would otherwise be difficult to access.

Figure 4:
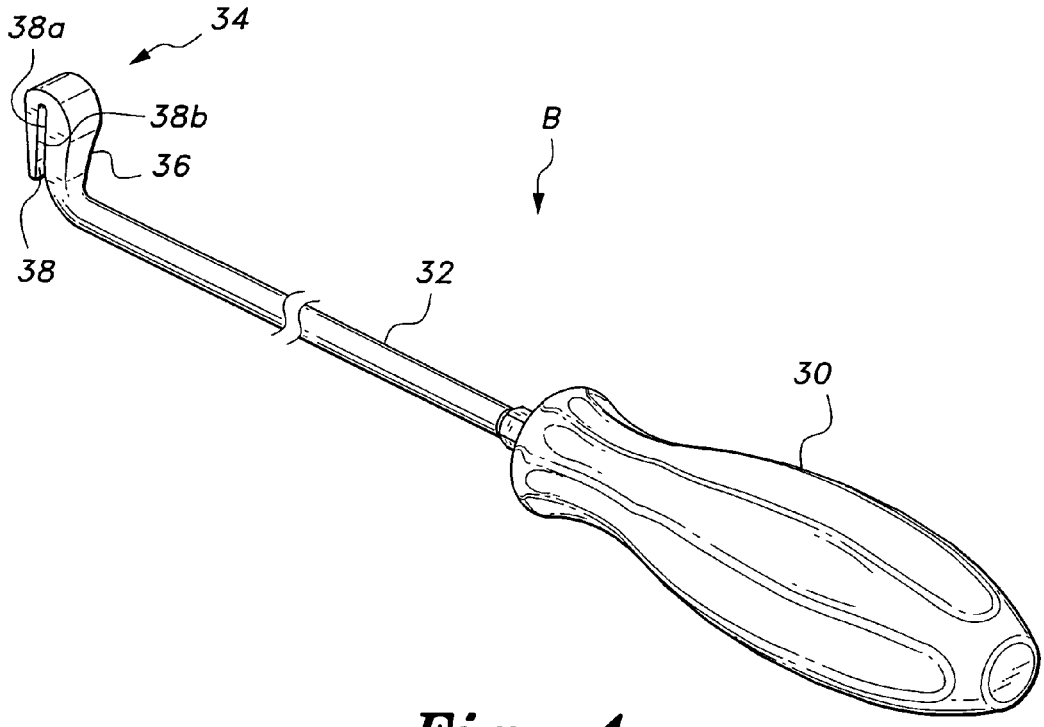
FIG. 4 is a perspective view of a second sheet metal pry hook included in a kit of sheet metal pry hooks according to-the present invention.

A second sheet metal pry hook, designated as B in FIG. 4, comprises a shank portion 32 having a handle 30 at one end and a hook member 34 at the other end. Hook member 34 includes a bend portion 36 that is perpendicular to the longitudinal axis of shank 32. Bend portion 36 terminates in a U-shaped, open-ended slot 38. Slot 38 is formed with spaced parallel, planar faces 38*a*, 38*b*. Slot 38 is normal to shank 32, but the open mouth of the slot is axially aligned with the shank 32.

Figure 5:
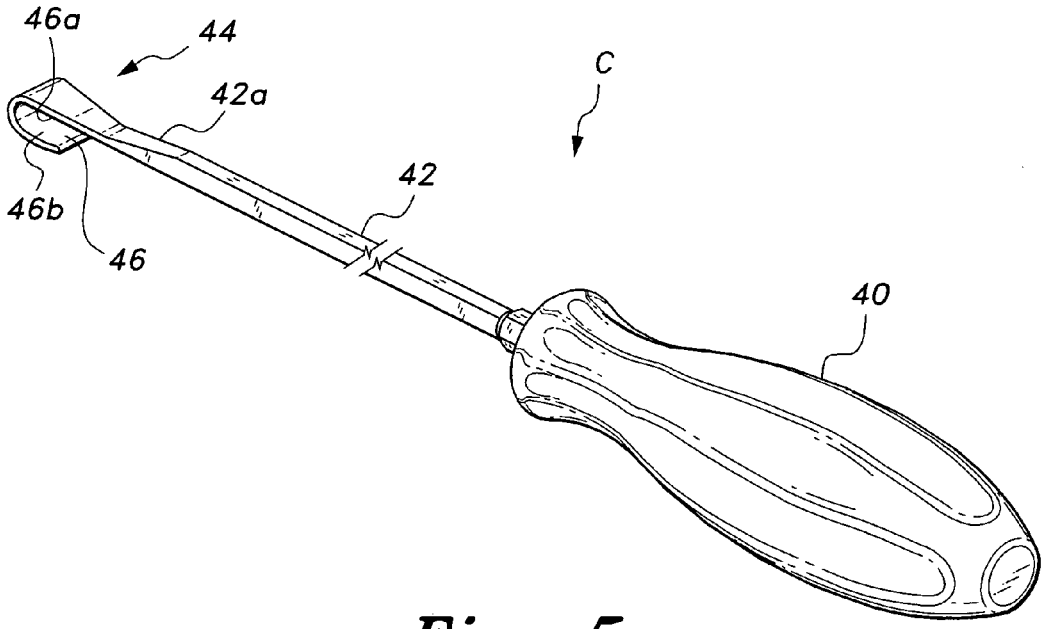
FIG. 5 is a perspective view of a third sheet metal pry hook included in a kit of sheet metal pry hooks according to the present invention.

FIG. 5 shows a third sheet metal pry hook C having a shank 42 of square or rectangular cross section. Handle 40 is disposed at one end of shank 42. The other end of the shank 42 is formed with a tapered portion 42*a* that terminates in a hook member 44. Hook member 44 is provided with a U-shaped, open ended slot 46 having spaced, parallel planar faces 46*a*, 46*b*. Slot 46 extends parallel to shank 42.

Figure 6:
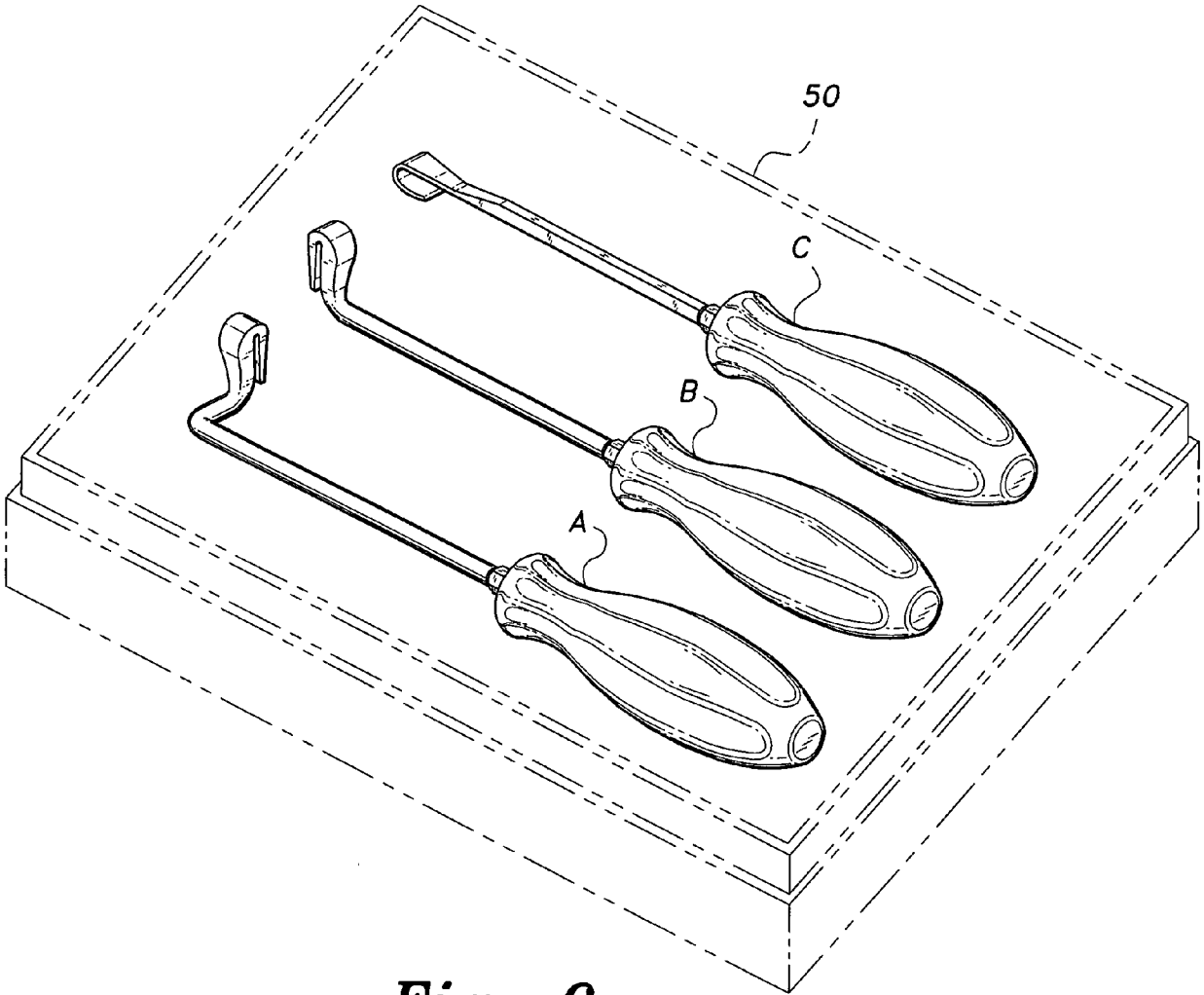
FIG. 6 is a perspective view of a kit of sheet metal pry hooks according to the present invention.

The configurations of pry hooks 10, B and C permit a user to access almost any automotive sheet metal panel edge arrangement, and allows the user to bend and align the same for repair. As shown in FIG. 6, the three pry hooks (with pry hook 10 being designated as pry hook A) may be available either individually or as a kit 50 for the convenience of the user.

It is to be understood that the present invention is not limited to the embodiments described above, but encompasses any and all embodiments within the scope of the following claims.

I claim:

1. A sheet metal pry hook tool, comprising:

a shank having a longitudinal axis, a first end and a second end;

a handle disposed at the first end of the shank; and a hook member defined at the second end of the shank, the hook member having a first bend portion extending from the shank perpendicular to the longitudinal axis of the shank and a second bend portion extending from said first bend portion perpendicular to a plane defined by the shank and the first bend portion, the second bend portion terminating in a U-shaped, open-ended slot, the slot having spaced, parallel, planar faces.

2. A kit of sheet metal pry hooks, comprising three pry hooks of different configurations, each of the three pry hooks having:

a shank having a longitudinal axis, a first end and a second end;

a handle disposed at the first end of the shank; and a hook member defined at the second end of the shank, the hook member having a U-shaped, open-ended slot and spaced, parallel, planar faces, wherein:

the hook member of a first one of said three pry hooks has a bend portion perpendicular to the longitudinal axis of said shank;

the shank of a second one of said three pry hooks has a tapered portion adjacent the hook member; and the hook member of a third one of said pry hooks has a first bend portion extending perpendicular to the longitudinal axis of said shank and a second bend portion extending the first bend portion perpendicular to a plane defined by the longitudinal axis of said shank and said first bend portion.

* * * * *